United States Patent [19]

Liu

[11] Patent Number: 4,974,272

[45] Date of Patent: Dec. 4, 1990

[54] WARM AND COOL WATER BED

[76] Inventor: Su H. Liu, 41-2 Lane 24,Shin-Kang Rd., Lin-Ya Dist. Kaohsiung, Taiwan

[21] Appl. No.: 441,472

[22] Filed: Nov. 27, 1989

[51] Int. Cl.[5] ..... A47C 27/08; A47C 7/057

[52] U.S. Cl. ..... 5/422; 5/66; 5/451

[58] Field of Search ..... 5/422, 421, 284, 451, 5/450, 60

[56] References Cited

U.S. PATENT DOCUMENTS

| | | | |
|---|---|---|---|
| 1,212,479 | 1/1917 | Hall | 5/284 |
| 3,689,949 | 9/1972 | Weinstein et al. | 5/60 |
| 3,772,717 | 11/1973 | Yuen et al. | 5/422 |
| 4,079,728 | 3/1978 | Gatts | 600/22 |
| 4,120,062 | 10/1978 | Anderson | 5/451 |
| 4,635,620 | 1/1987 | Ricchio | 5/453 |

FOREIGN PATENT DOCUMENTS

| | | | |
|---|---|---|---|
| 932779 | 7/1963 | United Kingdom | 5/451 |

*Primary Examiner*—Alexander Grosz

*Attorney, Agent, or Firm*—Fleit, Jacobson, Cohn, Price, Holman & Stern

[57] ABSTRACT

A warm and cool sick bed is provided including a water mattress supported from a bed frame. The water mattress containing water that can circulate with that contained in a water chamber settled at the lower section of the bed by means of water pipes, and the water in the water chamber possible to be warmed up by a heater tube or cooled down by a refrigerant tube.

3 Claims, 3 Drawing Sheets

WARM AND COOL WATER BED

BACKGROUND OF THE INVENTION

1. FIELD OF THE INVENTION

This invention concerns a kind of sick bed that can be cooled or warmed and used by a patient confined to bed for an extended period of time. A conventional sick bed is not suitable for a patient suffering from a stroke, or a form of paralysis, as the patient is quite liable to develop skin diseases and sores as a result of lying stationary on the bed for long periods of time without heat-dissipation and/or ventilation. Although a cooling mattress or a water mattress is sometimes placed upon a sick bed or a cooling fan is used to blow air over the bed mattress, these are not ideal methods for cooling or heating and ventilating a bed-confined patient.

SUMMARY OF THE INVENTION

The object of this invention is to provide a sick bed whose mattress can be warmed in cold weather and cooled in hot weather.

The sick bed according to the present invention comprises a bed frame, a housing, a foam rubber mattress and a water mattress as its main components.

The bed frame is provided with a support surface for supporting the foam rubber mattress and the water mattress and a shelf is provided below the support surface for support of the housing therefrom.

The housing is divided into three chambers for respectively receiving a compressor and a circulation pump and for storing water. The water storage chamber has therein a refrigerant tube communicating with a compressor for cooling the water in the chamber and also a heater tube for warming the water, if desired. A circulation pump is provided and functions to circulate water between the water storage chamber and the water mattress through water pipes provided for the purpose so that the water in the chamber, warmed or cooled, can circulate into the water mattress.

The water mattress is placed upon the foam rubber mattress and directly laid on by a patient. This is the main feature of this invention.

In addition, a push button and two turning buttons are provided on the housing for turning on or off the circulation pump, the heater and the compressor and for adjusting the temperature of the water within the range from 20° C. to 38° C.

DESCRIPTION OF THE PREFERRED EMBODIMENT

Figure 1:
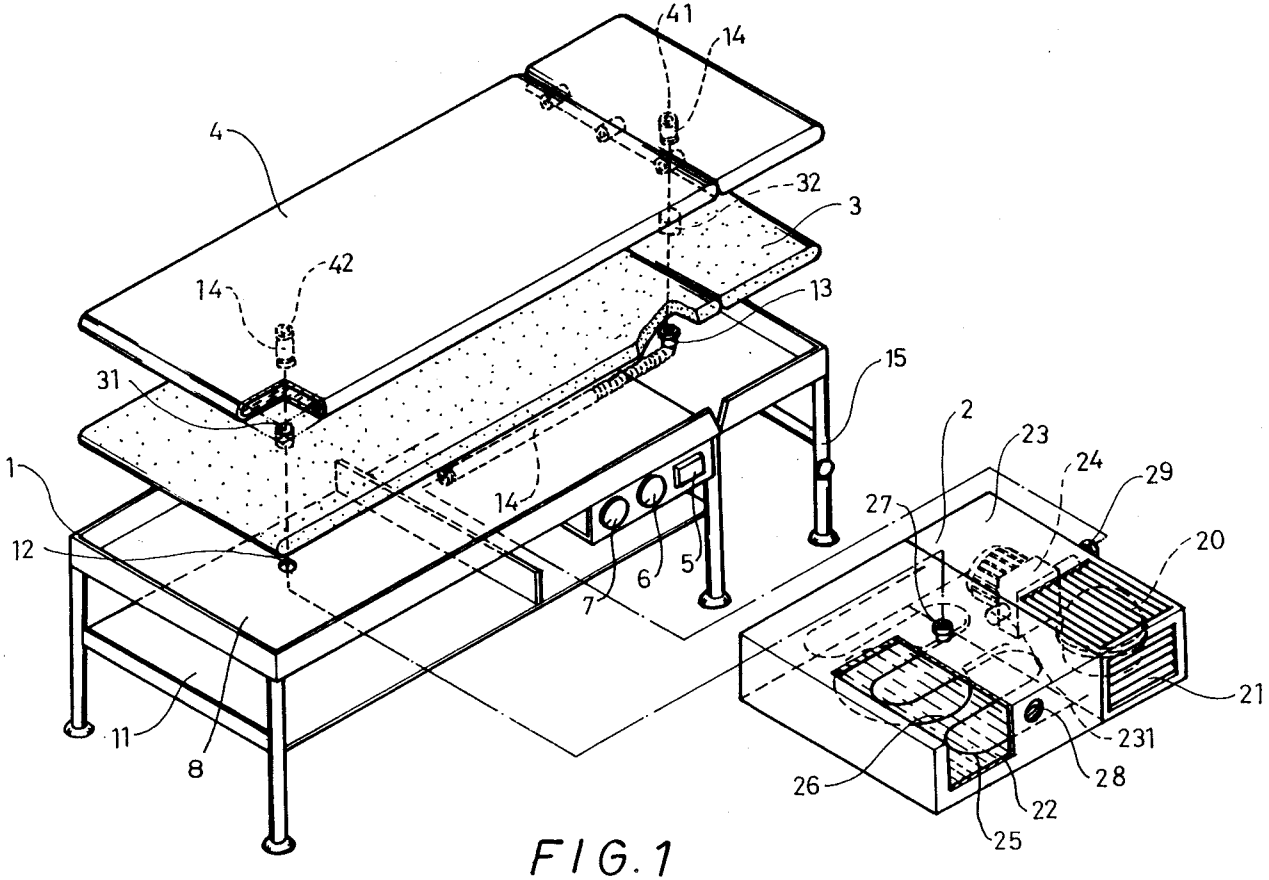
FIG. 1 is an exploded perspective view of a sick bed constructed in accordance with the present invention.
Figure 2:
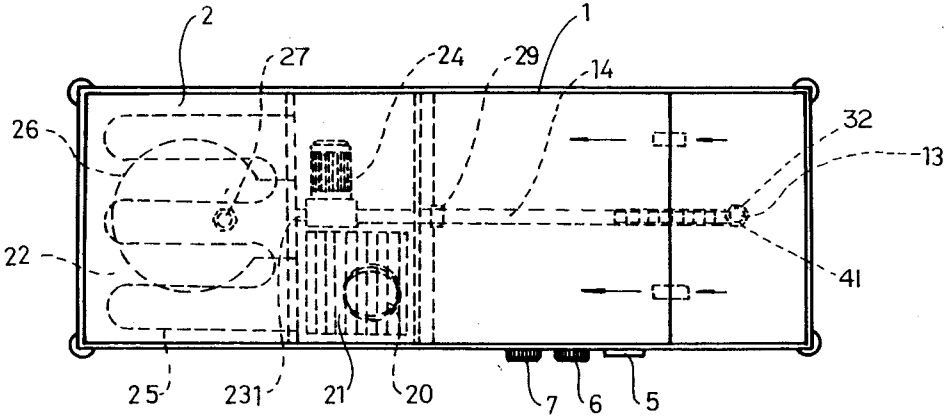
FIG. 2 is an top plan view of the sick bed.
Figure 3:
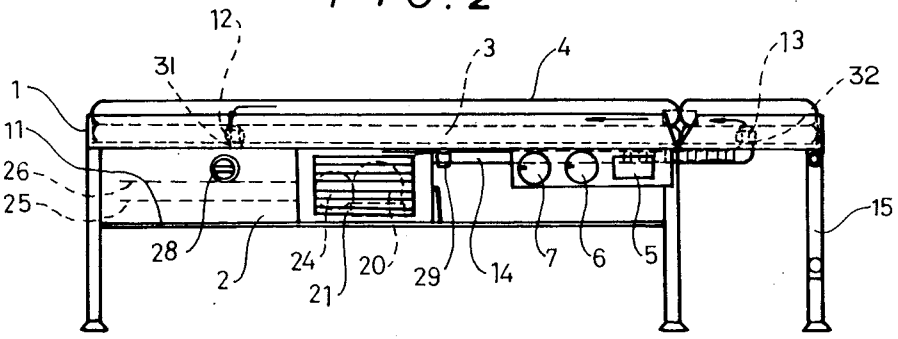
FIG. 3 is a side elevational view of the sick bed.

Referring to FIGS. 1, 2 and 3, the sick bed according to the present invention comprises a bed frame 1, a housing 2, a foam rubber mattress 3 and a water bed mattress 4 as the main components.

The bed frame 1 is provided with a shelf 11 below an upper support surface 8 and the housing 2 is divided into three chambers 21, 22 and 23 and is supported from the shelf 11. A compressor 20 is mounted within the chamber 21 and a refrigerant tube 25 extends from the compressor 20 into the water chamber 22. The water chamber 22 also has a heater tube 26 therein for warming the water within chamber 22 and the refrigerant tube 25 is provided for cooling the water. The chamber 22 is provided with a water return inlet 27 and a water access hole 28, said water return inlet 27 being used to return water from the mattress 4 to the chamber 22 when warming or cooling the mattress 4. The water access hole 28 is used for adding water to or withdrawing water from the chamber 22.

The chamber 23 has mounted therein a circulation pump 24 to circulate the water from the chamber 22 to the water mattress 4, through a water pipe 231, a water exit 29 at the side of the chamber 23 and a water pipe 14.

The foam rubber mattress 3 is laid directly on the support surface 8 of bed frame 1 and is provided with two round through holes 31 and 32 correspondingly aligned with two holes 12 and 13 in the support surface 8 of the bed frame 1 such that the water pipe 14 may circulate the water from the chamber 22 to the water mattress 4.

The water mattress 4 is positioned directly on the foam rubber mattress 3 and provided with a water inlet 41 and a water outlet 42 corresponding to the round through holes 31 and 32 in the foam rubber mattress 3, and the inlet 41 and outlet 52 are connected with the water pipes 14 so that the water can flow in the water mattress 4 through the inlet 41 and flow out through the outlet 42.

The main feature of this invention is that the water circulation can be performed by the circulation pump 24 functioning to circulate the water from the chamber 22 through the water pipe 14, to the water mattress 4 and back to the chamber 22. The temperature of the water can be reduced by the compressor 20 or increased by the heater tube 26. Thus, the water mattress 4 may be internally warmed or cooled.

A push button 5 and two turning buttons 6 and 7 are provided at the lower section of the bed frame 1. The push button 5 is operatively associated with and may be used is to turn on or off the circulation pump 25 and the turning buttons 6 and 7 provided are operatively associated with the compressors 20 and heater tube 26 to control the temperature of the water in the chamber 22. The water temperature may be adjusted to between 20° C. and 38° C., but the operation of the heater tube and compressor must not be done simultaneously. The electrical wiring for such control of the heater tube and compressor is a commonly known art, not to be described here.

Figure 4:
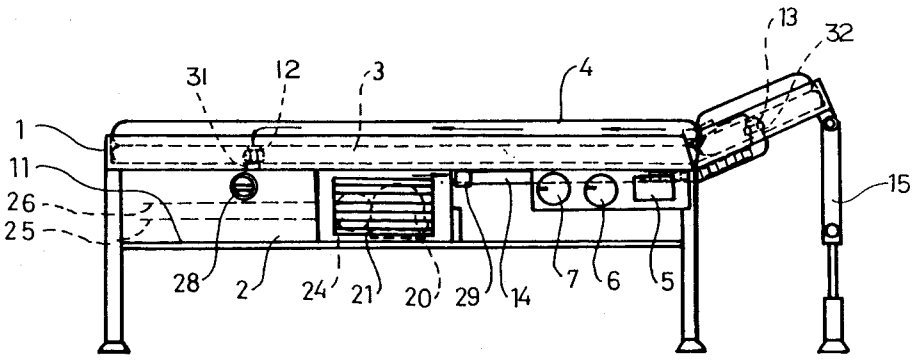
FIG. 4 is a side elevational view of the sick bed with the head end raised.

Next, referring to the FIG. 4, the bed frame 1 also is provided with a pair of front vertically extendable feet 15 for adjustably raising the front or head end of the bed frame 1, whereby a patient can lie thereon more comfortably. Also, the housing 2 can be positioned in a location remote from the bed, in which case the related water pipes and electrical lines should be extended.

The warm and cool sick bed is provided with the water mattress 4, which may have the water therein warmed or cooled, so that a patient confined on bed may avoid perspiration even in hot summer, and thereby not be liable to suffer from skin diseases or sores. The bed also may be used for a patient with fever to reduce his body temperature. In winter the mattress water can be warmed to keep a patient warm. Also, the bed can be utilized by a beauty parlor for treating women having skin beautifying treatments.

What is claimed is:

1. A warm and cool sick bed incorporating a frame defining an elongated horizontal support surface having opposite end portions with each end portion having an upstanding hole formed therethrough, a first foam material mattress disposed on said surface, a second water mattress disposed on said first mattress, said first mattress including opposite end sections disposed on said opposite end portions and having upstanding holes formed therethrough registered with the first mentioned holes, a water chamber defining housing including a water chamber and defining a water inlet and a water outlet for said chamber, pump means for pumping water from said water inlet, through said chamber and out of said water outlet, said second mattress including a downwardly opening water inlet and a downwardly opening water outlet, water inlet and water outlet pipes extending through said holes and communicating said water mattress water outlet with said water chamber inlet and said water chamber outlet with said water mattress inlet, said holes being spaced inward from all marginal edges of said mattresses.

2. The bed of claim 1 wherein said water chamber includes water temperature maintaining means operative to maintain the temperature of water within said chamber substantially at a predetermined temperature within a selected range of temperatures.

3. The bed of claim 1 wherein one of said end portions of said support surface defines the head end thereof and is supported from the other end portion of said support surface for adjustable angular displacement relative thereto about a horizontal axis extending transversely of said support surface, said mattresses each including corresponding head end portions thereof similarly angularly displacable relative to the remaining portions of the corresponding mattresses about horizontal transverse axes.

* * * * *